US005839214A

United States Patent [19]

Peterson

[11] Patent Number: 5,839,214

[45] Date of Patent: Nov. 24, 1998

[54] CORNER ADJUSTMENT ASSEMBLY FOR AN ADJUSTABLE FRAME

[76] Inventor: William L. Peterson, 424 NW. 21st St., Oklahoma City, Okla. 73103

[21] Appl. No.: 867,723

[22] Filed: Jun. 3, 1997

[51] Int. Cl.[6] ..... D06C 03/08

[52] U.S. Cl. ..... 38/102.4; 160/374.1

[58] Field of Search ..... 38/102, 102.4, 38/102.7, 102.91; 160/371, 372, 374.1, 381; 101/127.1; 248/188.1

[56] References Cited

U.S. PATENT DOCUMENTS

| | | | |
|---|---|---|---|
| 339,276 | 4/1886 | Dodge | 160/374.1 |
| 916,832 | 3/1909 | Bittlinger et al. | 160/381 X |
| 1,916,023 | 6/1933 | Shull | 160/374.1 |
| 3,529,653 | 9/1970 | Fey, Jr. | 160/374.1 |
| 3,882,616 | 5/1975 | Starzyk | 38/102.1 |
| 3,978,905 | 9/1976 | de Lama et al. | 160/378 |
| 4,255,886 | 3/1981 | Klarman | 38/102.3 |
| 4,301,853 | 11/1981 | Vidal | 160/374.1 |
| 4,409,749 | 10/1983 | Hamu | 38/102.3 |
| 4,432,150 | 2/1984 | Swonger | 38/102.5 |
| 5,396,721 | 3/1995 | Levine et al. | 38/102.3 |
| 5,502,906 | 4/1996 | Yamawaki | 38/102 |

*Primary Examiner*—Ismael Izaguirre

*Attorney, Agent, or Firm*—Dunlap & Codding, P.C.

[57] ABSTRACT

The present invention relates generally to an adjustable frame assembly for stretching and supporting a painter's canvas. The adjustable frame assembly is provided with a polygonally shaped frame structure encompassing an open area and adapted to support the painter's canvas across the open area. The frame structure includes a plurality of frame members cooperatively positioned to form the frame structure. Each frame member has one end movably connected to an adjacently disposed frame member to define one respective corner of the frame structure. The adjustable frame assembly is provided with a plurality of corner adjustment assemblies. Each corner adjustment assembly has a first end pivotally connected to one of a pair of adjacently disposed frame members defining one of the corners of the frame structure and, a second end pivotally connected to the other one of the pair of adjacently disposed frame members defining the one respective corner. Adjustment devices are provided for selectively adjusting at least one of the first and second ends of each corner adjustment assembly such that the pairs of adjacently disposed frame members defining the corners of the frame structure are selectively movable in response to the selective adjustment of the corner adjustment assemblies to thereby adjust the tension in the painter's canvas supported by the frame structure.

25 Claims, 6 Drawing Sheets

CORNER ADJUSTMENT ASSEMBLY FOR AN ADJUSTABLE FRAME

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

Generally, artists paint for the future generation because few artists are "recognized" during their lifetimes. Serious, knowledgeable artists seeking mastery ("artists"), pursue techniques which will extend the life of their works. A necessary enemy of any painting is the underlying painter's canvas upon which the paint is applied. Painter's canvases are generally flexible and subject to expansion and contraction with temperature and humidity, not to mention trauma through careless human treatment.

The painter's canvas is generally mounted on a wooden frame. Before paint is applied to the painter's canvas, the painter's canvas is primed with a material such as a rabbit glue or a polymer to stabilize the fabric in the painter's canvas and to insulate the painter's canvas from the paint. Generally, movement of the painter's canvas and a lack of insulation between the paint and the painter's canvas damages the painting. Thus, the longevity of the painting is increased by decreasing the amount of movement of the painter's canvas.

Oil paint requires about fifty years or more to fully dry. During drying it emits a gas through the surface of the paint. The tension on the painter's canvas changes (generally relaxes) during all steps of priming, painting and drying. The wood in the frame shrinks during aging and the painter's canvas and the frame expand or contract with variations in humidity and temperature. The movement caused by the relaxation of the painter's canvas and in the shrinking, expanding and contracting of the painter's canvas and the wooden frame can damage the painting and/or warp the wooden frame. In addition, when the wooden frame warps, the canvas must be removed therefrom and disposed on another frame thereby causing additional damage to the painting.

In view of the foregoing, there is a need for an inexpensive adjustable frame assembly which is simple to operate for supporting and stretching the painter's canvas and to thereby extend the longevity of paintings. It is to such an inexpensive and simple adjustable frame assembly that the present invention is directed.

BRIEF SUMMARY OF THE INVENTION

The present invention is directed to an adjustable frame assembly for stretching and supporting a painter's canvas. The adjustable frame assembly is provided with a polygonally shaped frame structure encompassing an open area. The adjustable frame assembly is adapted to support the painter's canvas across the open area. A plurality of cooperatively positioned frame members form the frame structure. Each of the frame members has one end movably connected to one end of an adjacently disposed frame member to define one respective corner of the frame structure.

The adjustable frame assembly is further provided with a plurality of corner adjustment assemblies. Each corner adjustment assembly has a first end pivotally connected to one of the frame members defining a portion of one of the corners of the frame structure and a second end pivotally connected to an adjacently disposed frame member defining the other portion of the respective corner. The adjustable frame assembly is provided with adjustment means for selectively adjusting at least one of the first and second ends of each corner adjustment assembly. The selective adjustment of the ends of each corner adjustment assembly moves the adjacently disposed frame members defining the corners of the frame structure to adjust the tension in the painter's canvas supported by the frame structure.

Thus, the corner adjustment assemblies of the present invention provide stability to the movable connections at each corner of the frame structure and permit one to independently expand or reduce each corner of the frame structure. This allows the selective equalization of tension in all areas of the painter's canvas through slight and calculated movements which do not abuse the frame structure or the painter's canvas and which lock each adjustment until readjustment.

DETAILED DESCRIPTION OF THE INVENTION

Definitions

The terms "painter's canvas" or "painter's canvases" as used herein refer to any canvas, linen or other material upon which paint can be applied. The terms "painter's canvas or "painter's canvases" also refer to materials which are subject to expansion and contraction due to temperature and humidity and which may or may not be treated with a primer such as a rabbit glue or a polymer upon which paint can be applied.

FIGS. 1–8

Figure 1:
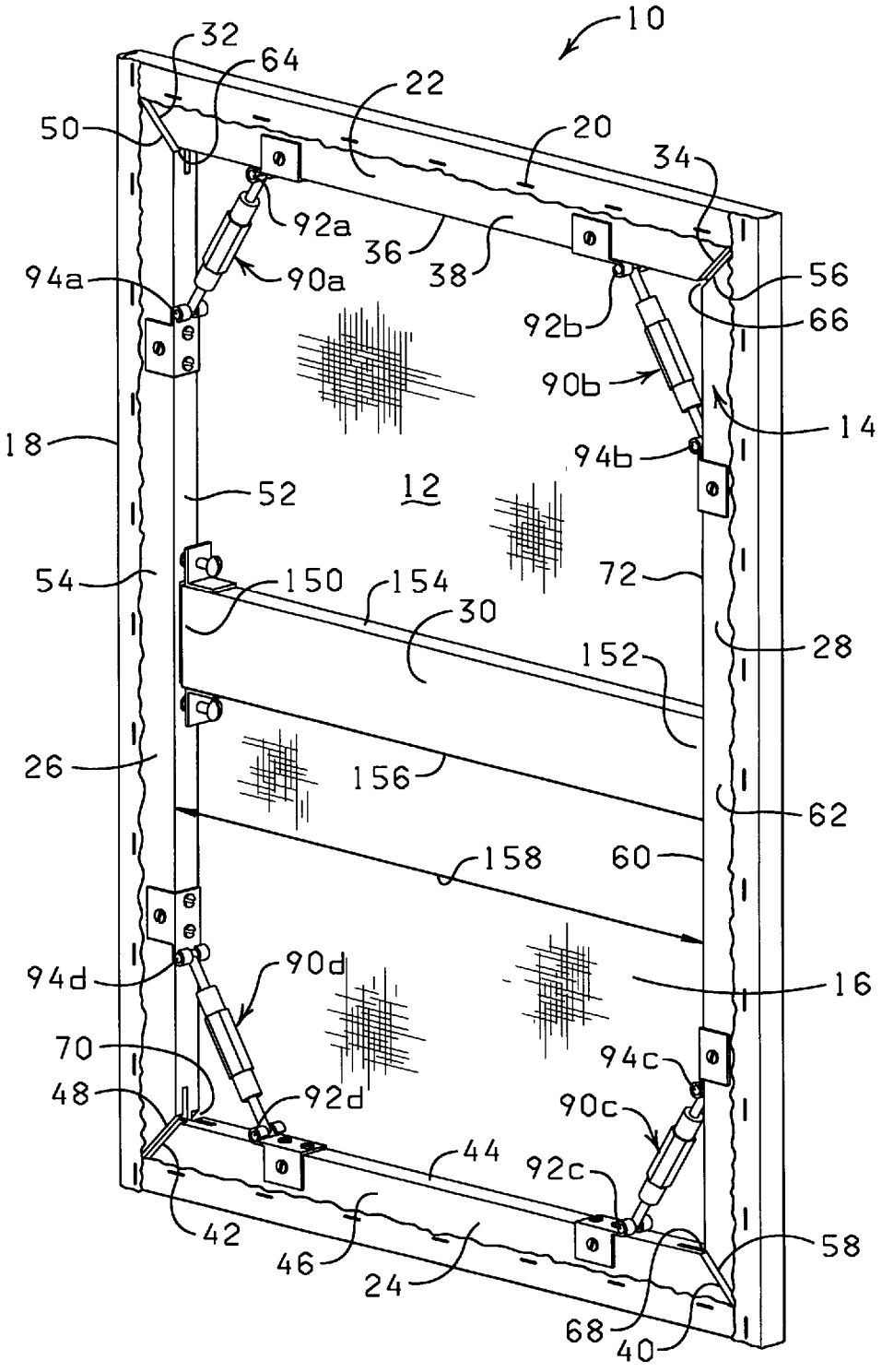
FIG. 1 is a perspective view depicting an adjustable frame assembly constructed in accordance with the present invention, the adjustable frame assembly including a frame structure with corner adjustment assemblies pivotally connected across each internal corner of the frame structure.

Referring now to the drawings and more particularly to FIG. 1, depicted therein and designated by the general reference numeral 10 is an adjustable frame assembly constructed in accordance with the present invention for stretching and supporting a painter's canvas 12. The adjustable frame assembly 10 is provided with a polygonally shaped frame structure 14 encompassing an open area 16 and adapted to support the painter's canvas 12 across the open area 16. The painter's canvas 12 is stretched about a perimeter 18 of the frame structure 14 and fastened in place by staples or tacks 20 which are driven through the painter's canvas 12 and into the frame structure 14, substantially as shown in FIG. 1.

The frame structure 14, which is substantially rectangular in configuration, is provided with a first end frame member 22, a second end frame member 24, a first side frame member 26, a second side frame member 28 and a brace member 30 movably disposed between the first side frame member 26 and the second side frame member 28.

The first end frame member 22 of the frame structure 14 has a first end 32, an opposed second end 34, an interior surface 36 extending generally between the first and second ends 32 and 34 thereof, and a rear surface 38 extending generally between the first and second ends 32 and 34 thereof.

The second end frame member 24 of the frame structure 14 is spatially disposed from the first end frame member 22. The second end frame member 24 has a first end 40, an opposed second end 42, an interior surface 44 extending generally between the first and second ends 40 and 42 thereof, and a rear surface 46 extending generally between the first and second ends 40 and 42 thereof.

The first side frame member 26 of the frame structure 14 is disposed generally between and perpendicularly to the first and second end frame members 22 and 24. The first side frame member 26 has a first end 48, an opposed second end 50, an interior surface 52 extending generally between the first and second ends 48 and 50 thereof and a rear surface 54 extending generally between the first and second ends 48 and 50 thereof.

The second side frame member 28 of the frame structure 14 is spatially disposed from the first side frame member 26 and disposed generally between and perpendicularly to the first and second end frame members 22 and 24. The second side frame member 28 has a first end 56, an opposed second end 58, an interior surface 60 extending generally between the first and second ends 56 and 58 thereof and a rear surface 62 extending generally between the first and second ends 56 and 58 thereof.

The first end 32 of the first end frame member 22 is slidably connected to the second end 50 of the first side frame member 26 to define an internal corner 64 of the frame structure 14. The second end 34 of the first end frame member 22 is slidably connected to the first end 56 of the second side frame member 28 to define an internal corner 66 of the frame structure 14. The second end 58 of the second side frame member 28 is slidably connected to the first end 40 of the second end frame member 24 to define an internal corner 68 of the frame structure 14. The second end 42 of the second end frame member 24 is slidably connected to the first end 48 of the first side frame member 26 to define an internal corner 70 of the frame structure 14. The interior surfaces 36, 44, 52 and 60 of the first end frame member 22, the second end frame member 24, the first side frame member 26 and the second side frame member 28 cooperate to provide the frame structure 14 with an internal perimeter 72 defining the open area 16 of the frame structure 14.

It should be understood that the slidable connections forming the respective corners 64, 66, 68, and 70 are substantially identical in construction. Thus, only the internal corner 70 defined by the connection between the second end 42 of the second end frame member 24 and the first end 48 of the first side frame member 26 will be described in detail hereinafter.

Figure 2:
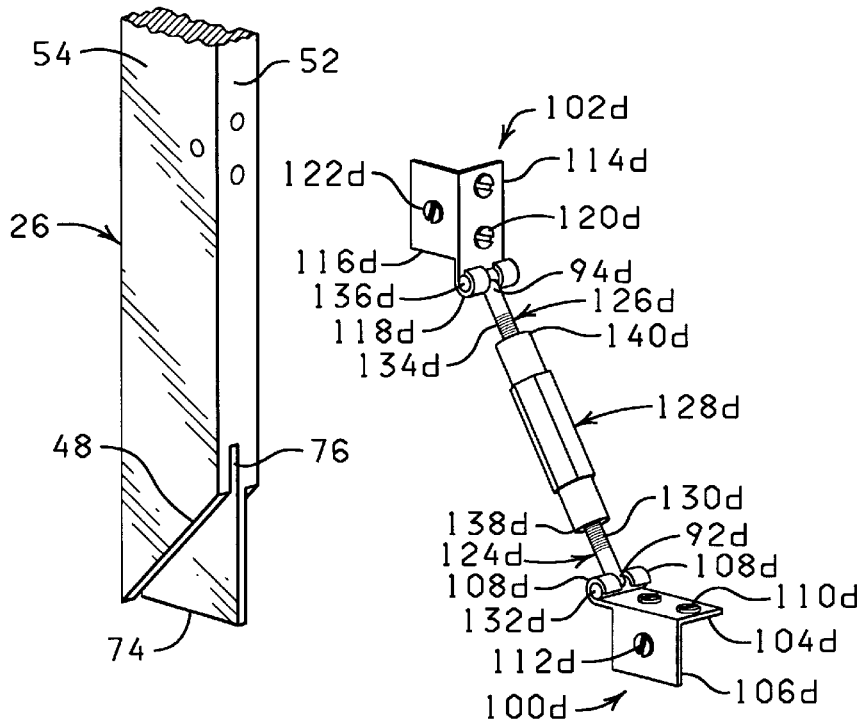
FIG. 2 is an exploded, perspective view of a corner of the adjustable frame assembly of FIG. 1.
Figure 2:
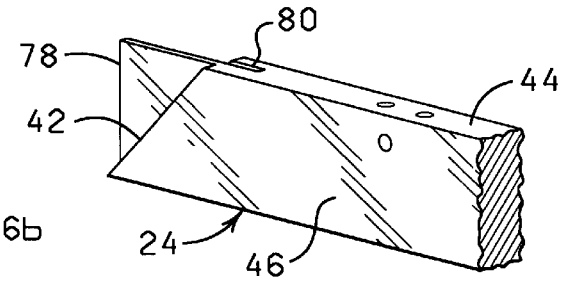
Figure 3:
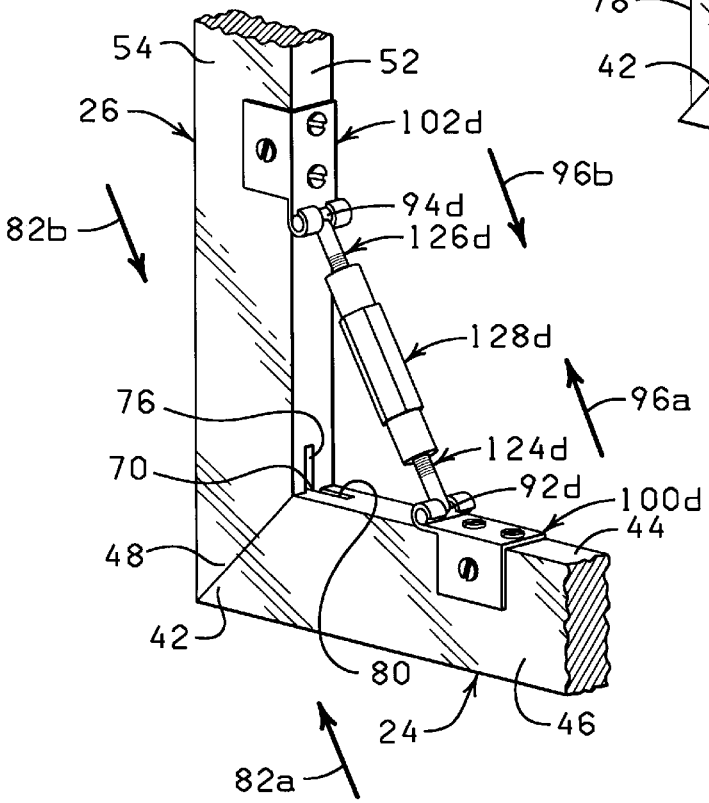
FIG. 3 is a perspective view of an assembled corner of the adjustable frame assembly depicted in FIG. 2 wherein the corner adjustment assembly disposed across the corner has been adjusted to a non-extended position such that the ends of adjacently disposed frame members defining the corner are abuttingly engaged.
Figure 4:
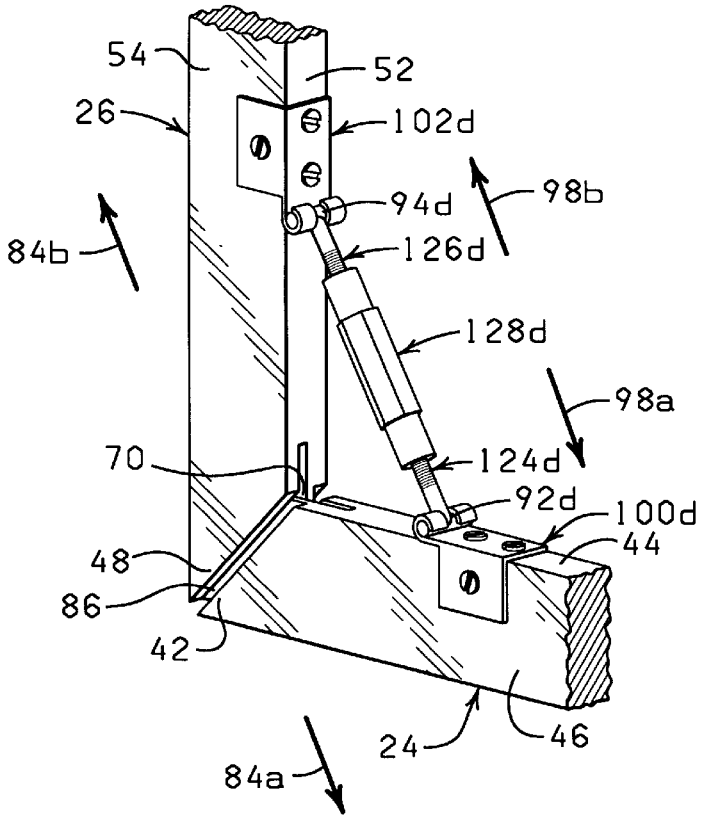
FIG. 4 is a perspective view of an assembled corner of the adjustable frame assembly depicted in FIG. 2 wherein the corner adjustment assembly disposed across the corner has been adjusted to an extended position such that the ends of the adjacently disposed frame members defining the corner are spatially disposed.

Referring now to FIGS. 2–4, shown therein is an exploded perspective view of the internal corner 68 defined by the connection between the first end 48 of the first side frame member 26 and the second end 42 of the second end frame member 24. The first side frame member 26 is provided with a projection or tenon 74 extending along the first end 48 thereof, and a cavity or mortise 76 extending into the first side frame member 26 through the interior surface 52 of the first end 48 thereof substantially as shown. The second end frame member 24 is also provided with a projection or tenon 78 extending along the second end 42 thereof, and a cavity or mortise 80 extending into the second end frame member 24 through the interior surface 44 of the second end 42 thereof substantially as shown.

In an assembled position, as shown in FIGS. 3 and 4, the projection or tenon 74 extending along the first end 48 of the first side frame member 26 is disposed in the cavity or mortise 80 in the second end 42 of the second end frame member 24 and the projection or tenon 78 extending along the second end 42 of the second end frame member 24 is disposed in the cavity or mortise 76 in the first end 48 of the first side frame member 26 so as to form the slidable connection connecting the first end 48 of the first side frame member 26 to the second end 42 of the second end frame member 24. As indicated by the arrows 82*a* and 82*b* in FIG. 3, force can be applied to the first side frame member 26 and the second end frame member 24 to move the first end 48 of the first side frame member 26 into engagement with the second end 42 of the second end frame member 24. Likewise, as indicated by the arrows 84*a* and 84*b* in FIG. 4, force can be applied to the first side frame member 26 and the second end frame member 24 in a substantially opposite direction to move the first side frame member 26 and the second end frame member 24 apart such that a gap 86 forms between the first end 48 and the second end 50 of the first side frame member 26 and the second end frame member 24, respectively.

Referring again to FIG. 1, the adjustable frame assembly 10 is provided with a plurality of corner adjustment assemblies 90 disposed across the open area 16 adjacent each of the internal corners 64, 66, 68 and 70 of the frame structure 14. The corner adjustment assemblies 90 serve to strengthen the slidable connections of the frame structure 14, and to lock or secure the relative position of the frame members 22, 24, 26 and 28 of the frame structure 14 against the tension of the painter's canvas 12.

Four corner adjustment assemblies 90 are shown in the embodiment of FIG. 1 and designated therein by the reference numerals 90*a*, 90*b*, 90*c* and 90*d* for purposes of clarity. Each of the corner adjustment assemblies 90 are substantially identical in construction and use. Thus, only the corner adjustment assembly 90*d* will be described in detail hereinafter.

The corner adjustment assembly 90*d* has a first end 92*d* and a second end 94*d*. The corner adjustment assembly 90*d* permits the first and second ends 92*d* and 94*d* of the corner adjustment assembly to be moved toward each other (as depicted by arrows 96*a* and 96*b* in FIG. 3) and away from each other (as depicted by arrows 98*a* and 98*b* in FIG. 4). The selective movement of the first end 92*d* and the second end 94*d* of the corner adjustment assembly 90*d* moves the second end 42 of the second end frame member 24 and the first end 48 of the first side member 26 to thereby adjust the tension of the painter's canvas 12 supported by the frame structure 14, near the internal corner 70 thereof.

Referring now to FIGS. 2–4, the corner adjustment assembly 90*d* connected between the first side frame member 26 and the second end frame member 24 of the frame structure 14 is shown in more detail. The corner adjustment assembly 90*d* is provided with a substantially L-shaped first bracket 100*d* pivotally connected to the first end 92*d* of the corner adjustment assembly 90*d* and a substantially L-shaped second bracket 102*d* pivotally connected to the second end 94*d* of the corner adjustment assembly 90*d*.

The substantially L-shaped first bracket 100*d* includes a first leg member 104*d*, a second leg member 106*d* and a pair of spatially disposed collars 108*d* connected to the first leg member 104*d*. The first leg member 104*d* of the first bracket 100*d* is shaped to matingly engage the interior surface 44 of the second end frame member 24 and is rigidly connected thereto by any conventional means such as screws 110*d*. The second leg member 106*d* of the first bracket 100*d* is shaped to matingly engage the rear surface 46 of the second end frame member 24 and is rigidly connected thereto by any conventional means such as screws 112*d*. The spatially disposed collars 108*d* will be discussed hereinafter.

The substantially L-shaped second bracket 102*d* includes a first leg member 114*d*, a second leg member 116*d* and a pair of spatially disposed collars 118*d* connected to the first leg member 114*d*. The first leg member 114*d* of the second bracket 102*d* is shaped to matingly engage the interior surface 52 of the first side frame member 26 and is rigidly connected thereto by any conventional method such as screws 120*d*. The second leg member 116*d* of the second bracket 102*d* is shaped to matingly engage the rear surface 54*d* of the first side frame member 26 and is rigidly connected thereto by any conventional method such as screws 122*d*. The pair of spatially disposed collars 118*d* of the second bracket 102*d* will be discussed hereinafter.

The corner adjustment assembly 90*d* is further provided with a first substantially T-shaped member 124*d*, a second substantially T-shaped member 126*d* and a coupling assembly 128*d* coupling the first T-shaped member 124*d* to the second T-shape member 126*d*. The first substantially T-shaped member 124*d* has an externally threaded shaft portion 130*d* and a pin portion 132*d* disposed perpendicularly to the externally threaded shaft portion 130*d*. The pin portion 132*d* of the first T-shaped member 124*d* is surrounded by the pair of collars 108*d* of the first bracket 100*d* to form the pivotal connection between the first T-shaped member 124*d* and the first bracket 100*d*.

The second T-shaped member 126*d* of the corner adjustment assembly 90*d* has an externally threaded shaft portion 134*d* and a pin portion 136*d* disposed perpendicularly to the externally threaded shaft portion 134*d*. The pin portion 136*d* of the second T-shaped member 126*d* is surrounded by the pair of collars 118*d* of the second bracket 102*d* to form the pivotal connection between the second T-shaped member 126*d* and the second bracket 102*d*.

The coupling assembly 128*d* of the corner adjustment assembly 90*d* has a first end 138*d*, a second end 140*d* and an internally threaded bore (not shown) extending generally between the first end 138*d* and the second end 140*d* thereof. The internally threaded bore of the coupling assembly 128*d* threadingly receives at least a portion of the threaded shaft portion 130*d* of the first T-shaped member 124*d* through the first end 138*d* of the coupling assembly 128*d* and threadingly receives at least a portion of the threaded shaft portion 134*d* of the second T-shaped member 126*d* through the second end 140*d* of the coupling assembly 128*d*.

Once the threaded shaft portions 130*d* and 134*d* of the first T-shaped member 124*d* and the second T-shaped member 126*d*, respectively, are disposed in the internally threaded bore of the coupling assembly 128*d* and the corner adjustment assembly 90*d* is installed on the frame structure 14, the coupling assembly 128*d* can be selectively rotated in one direction to decrease the distance between the first end 92*d* and the second end 94*d* of the corner adjustment assembly 90*d* to a non-extended position such that the second end frame member 24 and the first side frame member 26 of the frame structure 14 are moved inwardly as indicated by the arrows 82*a*, 82*b*, 96*a* and 96*b* in FIG. 3 until the second end 42 of the second end frame member 24 and the first end 48 of the first side frame member 24 are abuttingly disposed. The coupling assembly 128 can also be selectively rotated in an opposite direction to increase the distance between the first end 92*d* and the second end 94*d* of the corner adjustment assembly 90*d* such that the second end 42 of the second end frame member 24 and the first end 48 of the first side frame member 26 of the frame structure 14 are moved outwardly as indicated by the arrows 84*a*, 84*b*, 98*a* and 98*b* in FIG. 4. By moving the second end 42 of the second end frame member 24 and the first end 48 of the first side frame member 26 of the frame structure 14, the corner adjustment assembly 90*d* permits one to selectively and gently adjust the tension in the painter's canvas 12 supported by the frame structure 14 near the internal corner 70 thereof so that the frame structure 14 and the paint on the painter's canvas 12 are not damaged or traumatized by the adjustment.

Figure 5:
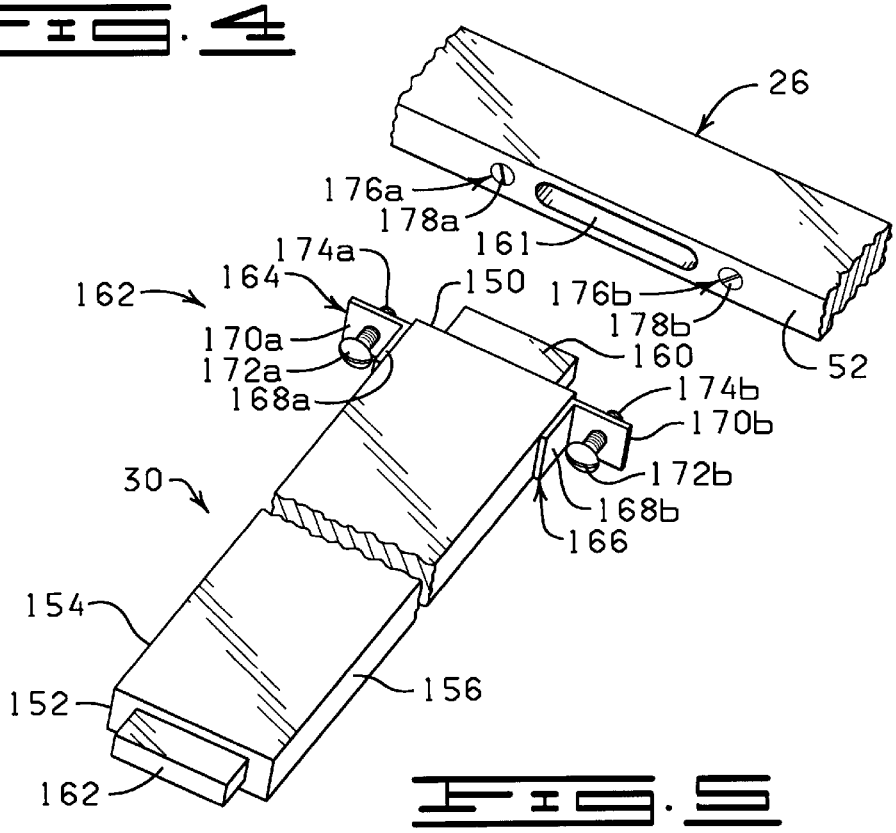
FIG. 5 is an exploded, perspective view depicting a brace member of the adjustable frame assembly of FIG. 1 having a brace adjustment assembly of the present invention connected to one end thereof.
Figure 6:
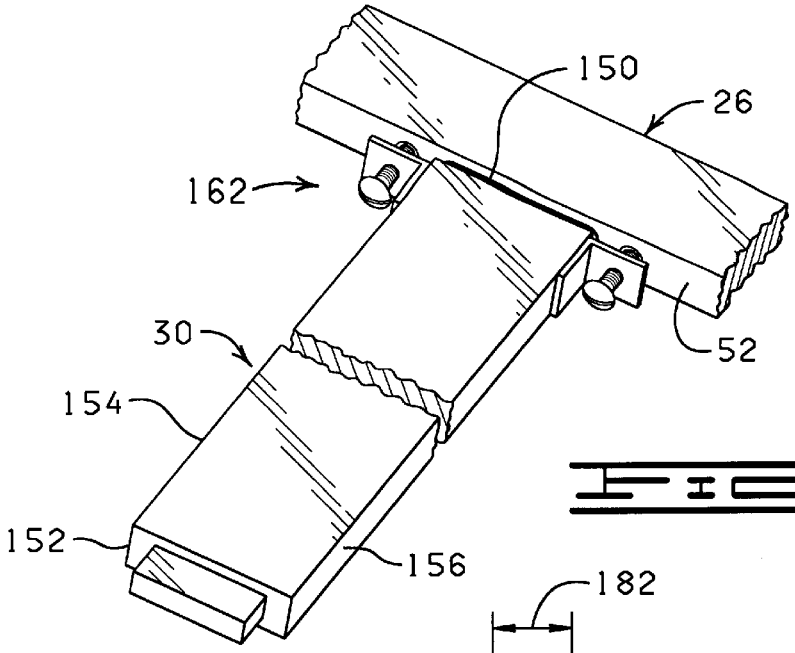
FIG. 6 is a perspective view of the brace member and brace adjustment assembly of FIG. 5 in an assembled condition wherein a tenon or projection of the brace member of FIG. 5 is disposed in a mortise or cavity provided in an adjacently disposed frame member.

Referring now to FIG. 1 in combination with FIGS. 5 and 6, the brace member 30 of the adjustable frame assembly 10 will be described in detail. The brace member 30 is disposed between a pair of opposed frame members such as the first side frame member 26 and the second side frame member 28. The brace member 30 has a first end 150, a second end 152, a first side 154, a second side 156 and a length 158 extending generally between the first end 150 and the second end 152 thereof. A pair of projections or tenons 160 extend a distance past the first end 150 and the second end 152, respectively, of the brace member 30. The pair of projections or tenons 160 and 162 of the brace member 30 are slidably disposed in a corresponding pair of cavities or mortises 161 formed in the first side frame member 26 and the second side frame member 28, respectively.

The length 158 of the brace member 30 is less than the distance between the opposed pair of frame members (the first and second side frame members 26 and 28) to permit the distance between the opposed pair of frame members 26 and 28 to be decreased when adjusting the tension of the painter's canvas 12.

The brace member 30 is provided with a brace adjustment assembly 162 disposed on at least one of the first and second ends 150 and 152 of the brace member 30. The brace adjustment assembly 162 is provided with a first substantially L-shaped bracket 164 connected to the first side 154 of the brace member 30, and a second L-shaped bracket 166 connected to the second side 156 of the brace member 30. Because the first and second L-shaped brackets 164 and 166 are substantially identical in construction and operation, for purposes of clarity only the first L-shaped bracket 164 will be described hereinafter. However, like parts on the first and second L-shaped brackets 164 and 166, respectively, will be designated in the drawings with the same numeral but different alphabetic suffixes a and b, respectively.

The first L-shaped bracket 164 of the brace adjustment assembly 162 has a first leg member 168, and a second leg member 170 extending from the first leg member 168. The first leg member 168 is connected to the first side 154 of the brace member 30 such that the second leg member 170 extends a distance from the brace member 30.

The second leg member 170 of the first L-shaped bracket 164 has a threaded aperture (not shown) formed through a portion thereof. A threaded shaft 172 is disposed in the threaded aperture of the second leg member 170 such that upon rotation of the threaded shaft 172 in a preselected direction via a screwdriver, for example, a first end 174 of the threaded shaft 172 moves a distance beyond the first end 150 of the brace member 30 to engage the first side frame member 26 to adjust the distance between the pair of opposed frame members 26 and 28 to adjust the tension of the painter's canvas 12 secured thereto.

The brace adjustment assembly 162 is further provided with a pair of rigid reinforcement members 176 spatially disposed in the first side frame member 26. The reinforcement members 176 serve to prevent damage to the first side frame member 26 by providing rigid abutment surfaces 178 adapted to be engaged by the threaded shafts 172 extending through the first and second L-shaped brackets 164 and 166 of the brace adjustment assembly 162.

In one embodiment, the abutment surfaces 178 of the reinforcing members 176 are disposed about level with the interior surface 52 of the first side frame member 26 and the reinforcing members 176 are screws. However, it should be understood that any means can be utilized by the present invention to reinforce the first side frame member 26 to prevent damage thereto. For example, the reinforcing members 176 could be one or more rigid spacers disposed between the threaded shafts 172 and the first side frame member 26.

Figure 7:
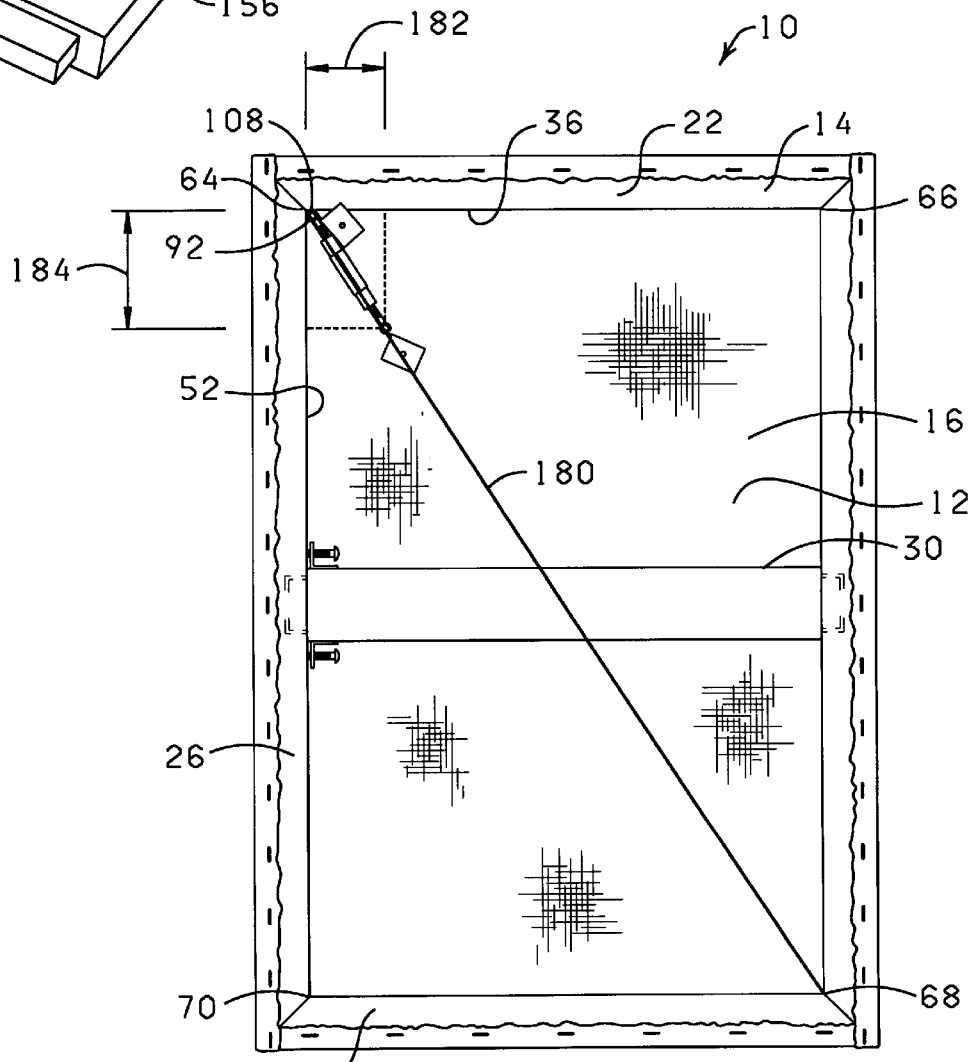
FIG. 7 is a back view of the frame structure depicted in FIG. 1 illustrating a method for installing the corner adjustment assemblies of the present invention onto the frame structure.
Figure 8:
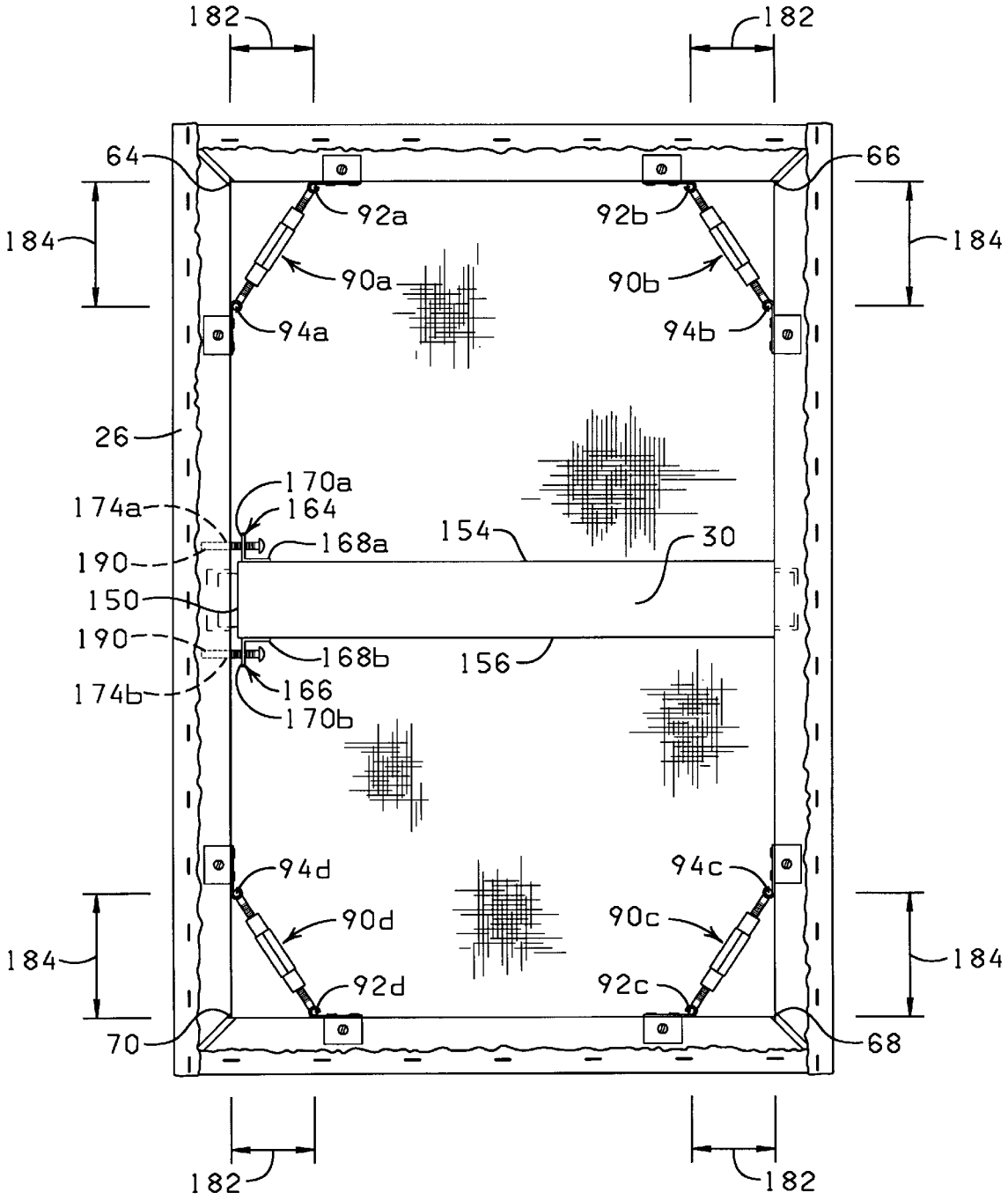
FIG. 8 is a back view of the adjustable frame assembly depicted in FIG. 1 having one of the corner adjustment assemblies extending across each corner of the frame structure and the brace member extending between oppositely disposed frame members of the frame structure.

Referring now to FIGS. 7–8, a method for producing the adjustable frame assembly 10 for stretching and supporting the painter's canvas 12 will be described. The rectangularly shaped frame structure 14 encompassing the open area 16 and having the brace member 30 movably disposed between an opposing pair of frame members (first side frame member 26 and second side frame member 28) with the painter's canvas 12 disposed across the open area 16 encompassed by the frame structure 14 is provided. The frame members 22, 24, 26 and 28 are pressed inwardly until the four internal corners 64, 66 68 and 70 of the frame structure 14 are abuttingly disposed and one frame member extends from an adjacently disposed frame member at an angle of about 90 degrees as shown in FIG. 7. Then, the first and second ends 92 and 94 of the corner adjustment assemblies 90 are moved inwardly to a non-extended position as hereinbefore described with reference to FIG. 3 to provide the corner adjustment assemblies 90 with a substantially same length extending generally between the first and second ends 92 and 94 thereof.

As shown in FIG. 7, a string 180 is then disposed diagonally across the open area 16 encompassed by the frame structure 14 from the internal corner 64 of the frame structure 14 to an opposing corner (the internal corner 68) of the frame structure 14 and then fixed in this position by means of thumbtacks (not shown), for example. One of the corner adjustment assemblies 90 is then disposed underneath the string 180 in the internal corner 64 adjacent the string 180 such that the spatially disposed pair of collars 108 of the first bracket 100 of the corner adjustment assembly 90 contacts the interior surfaces 36 and 52 of adjacently disposed frame members (the first end frame member 22 and the first side frame member 26) and the remainder of the corner adjustment assembly 90 extends from the internal corner 64 along the string 180.

In this position, a first measurement or distance 182 is determined by measuring from the internal corner 64 along the first end frame member 22 to a point disposed substantially normal to the second end 94 of the corner adjustment assembly 90. A second measurement or distance 184 is determined by measuring from the internal corner 64 along the first side frame member 26 to a point disposed substantially normal to the second end 94 of the corner adjustment assembly 90.

The string 180 is then removed from the frame structure 14 and the corner adjustment assembly 90 is disposed across at least a portion of the open area 16 adjacent the internal corner 64 of the frame structure 14 such that the first end 92 and the second end 94 are disposed substantially parallel to a diagonal line extending between adjacently disposed corners (the internal corner 66 and the internal corner 70). In other words, the first end 92 and the second end 94 of the corner adjustment assembly 90 are disposed a distance substantially equal to the first measurement 182 and the second measurement 184, respectively, from the internal corner 64. In this position, the first bracket 100 and the second bracket 102 of the corner adjustment assembly 90 are connected to the frame structure 14 via any suitable means such as glue or screws as previously discussed hereinbefore with reference to FIG. 2. The remaining corner adjustment assemblies 90 are then installed on the frame structure 14 utilizing the first and second measurements 182 and 184 described above and substantially as shown in FIG. 8.

The corner adjustment assemblies 90 provide stability to each of the internal corners 64, 66, 68 and 70 of the frame structure 14. In addition, the corner adjustment assemblies 90 permit the expansion or contraction of the perimeter of the frame structure 14 so that the ratio of length to width of the frame structure 14 is proportional to the movement of the length and width from the original 45 degree line of the mitered or internal corners 64, 66, 68 and 70 of the frame structure 14. This particular configuration of the corner adjustment assemblies 90 provides controlled or even stretching of the painter's canvas 12 which generally prevents the undesirable stressing of the painter's canvas 12 in the lesser dimension.

Once each of the corner adjustment assemblies 90 are installed on the frame structure 14, the coupling assembly 128 of each of the corner adjustment assemblies 90 can be rotated or adjusted with any suitable wrench, for example, to selectively adjust the tension in the painter's canvas 12 supported by the frame structure 14 as hereinbefore described with reference to FIGS. 2–4.

Once the tension is adjusted in the painter's canvas 12, a pair of spatially disposed openings 190 (FIG. 8) are drilled into the first side frame member 26 on either side of the brace member 30 and reinforcing members 176, such as screws, are screwed or inserted into the openings 190 until the abutment surfaces 178 on such reinforcing members 176 are disposed about level with the interior surface 52 of the first side frame member 26. The first leg member 168a of the first L-shaped bracket 164 is then disposed adjacent the first side 154 of the brace member 30, near the first end 150 thereof. In this position, the first L-shaped bracket 164 is secured to the brace member 30 by any conventional means such as by screws or glue. Then, the first leg member 168b of the second L-shaped bracket 166 is disposed adjacent the second side 156 of the brace member 30, near the first end 150 thereof, and is secured to the brace member 30 by any conventional means, such as be screws or glue.

Once the first and second L-shaped brackets 164 and 166 are disposed on opposite sides of the brace member 30, the threaded shafts or screws 172 can be inserted into the apertures (not shown) provided in the second leg members 170 thereof and tightened until the first ends 174 of the threaded shafts 172 engage the reinforcing members 176 disposed in the first side frame member 26.

FIG. 9

Figure 9:
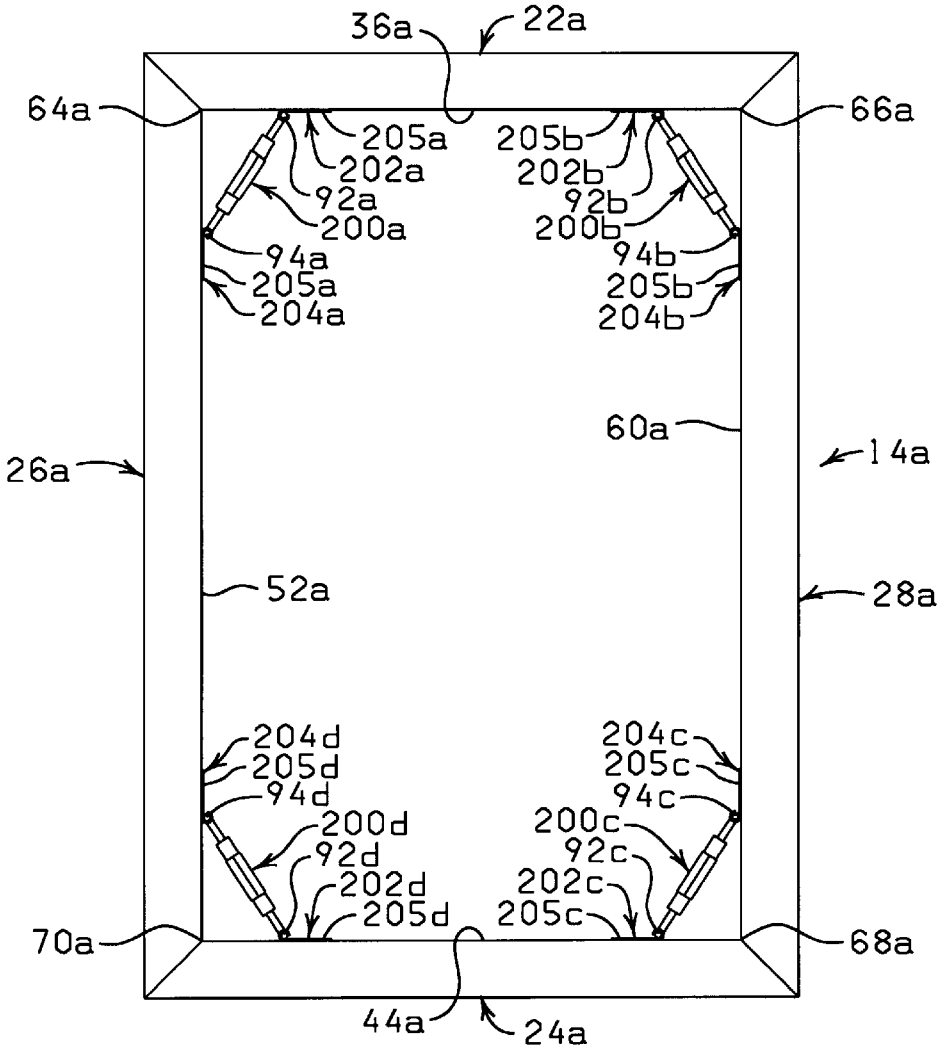
FIG. 9 is a plan view of a substantially rectangular item of furniture having a second embodiment of the corner adjustment assemblies of the present invention installed across each internal corner thereof.

Referring now to FIG. 9, shown therein and designated by the reference numeral is a second embodiment of a corner adjustment assembly 200 of the present invention which is depicted as being disposed across four internal corners 64*a*, 66*a*, 68*a* and 70*a* and connected to interior surfaces 36*a*, 44*a*, 52*a* and 60*a* provided in a rectangular item of furniture 14*a* to provide additional strength and reinforcement thereto. The corner adjustment assembly 200 is substantially identical in construction and use as the corner adjustment assembly 90 hereinbefore described with reference to FIGS. 2–4, except that each of a first bracket 202 and a second bracket 204 of the corner adjustment assembly 200 are provided with a substantially planar body member 205 rigidly connected to the interior surfaces 36*a*, 44*a*, 52*a* and 60*a* of the item of furniture 14*a*. The corner adjustment assemblies 200 can be installed on the item of furniture 14*a* by the method previously discussed with reference to FIGS. 7 and 8.

FIG. 10

Figure 10:
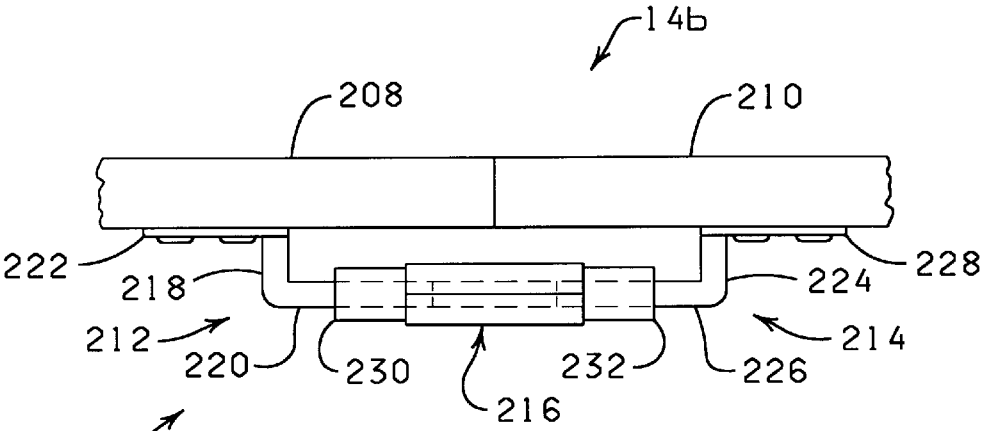
FIG. 10 is an elevational, fragmental view of two abutting members having an adjustment assembly constructed in accordance with the present invention connected thereto such that the adjustment assembly spans the intersection of the two members.

Referring now to FIG. 10, shown therein and designated by the reference numeral 206 is an adjustment assembly constructed in accordance with the present invention which is shown as being disposed across the intersection of two abutting and parallel disposed members 208 and 210 of an item of furniture 146. The adjustment assembly 210 is provided with a first substantially L-shaped member 212, a second substantially L-shaped member 214 and a coupling assembly 216 coupling the first L-shaped member 212 to the second L-shaped member 214.

The first L-shaped member 212 has a spacer portion 218 and an externally threaded shaft portion 220. The spacer portion 218 of the first L-shaped member 212 is rigidly connected to a first substantially planar bracket 222, and the first bracket 222 is rigidly connected to the first member 208 of the item of furniture 146 so that the first L-shaped member 212 is rigidly connected to the first member 208 of the item of furniture 146.

The second L-shaped member 214 has a spacer portion 224 and an externally threaded shaft portion 226 extending toward the first L-shaped member 212. The spacer portion 224 of the second L-shaped member 214 is rigidly connected to a second substantially planar bracket 228, and the second bracket 228 is rigidly connected to the second member 210 of the item of furniture 146 so that the second L-shaped member 214 is rigidly connected to the second member 210 of the item of furniture 146.

The coupling assembly 216 of the adjustment assembly 206 has a first end 230, a second end 232 and an internally threaded bore (not shown) extending generally between the first end 230 and the second end 232 thereof. The internally threaded bore of the coupling assembly 216 threadingly receives the threaded shaft portion 220 of the first L-shaped member 212 through the first end 230 of the coupling assembly 216 and threadingly receives the threaded shaft portion 220 of the second L-shaped member 214 through the second end 232 of the coupling assembly 216.

Once the threaded shaft portions 220 and 226 of the first and second L-shaped members 212 and 214, respectively, are disposed in the internally threaded bore of the coupling assembly 216 and the adjustment assembly 206 is installed across the intersection of the two parallel extending members 208 and 210 of the item of furniture 146, the coupling assembly 216 can be selectively rotated to decrease the distance between the first L-shaped member 212 and the second L-shaped member 214 of the adjustment assembly 206 to tightly clamp the two parallel extending members 208 and 210 of the item of furniture 146 together.

Because the tension on the painter's canvas 12 changes (generally relaxes) due to many factors such as humidity and temperature, the adjustable frame assembly 10 which has been shown and described herein is clearly an improvement over the prior art frames. That is, the movement caused by the relaxation of the painter's canvas 12 and in the shrinking, expanding and contracting of the painter's canvas 12 and the wooden frame can damage the painting and/or warp the wooden frame. The corner adjustment assemblies 90 and the brace adjustment assembly 162 of the present invention permit the tension in the painter's canvas 12 to be easily, gently and selectively adjusted so that the longevity of the painting is enhanced.

Changes may be made in the construction and operation of the various components and assemblies described herein and changes may be made in the steps or the sequence of steps of the methods described herein without departing from the spirit and the scope of the invention as defined in the following claims.

What is claimed is:

1. An adjustable frame for stretching and supporting a painter's canvas, comprising:

a polygonally shaped frame structure encompassing an open area and adapted to support the painter's canvas across the open area, the frame structure comprising:

a plurality of frame members cooperatively positioned to form the frame structure, each frame member having one end movably connected to an adjacently disposed frame member to define one respective corner of the frame structure;

a plurality of corner adjustment assemblies each corner adjustment assembly including:

a first shaft having a first end;

a second shaft having a first end, the first end of the first shaft being spaced a distance from the first end of the second shaft;

adjustment means for selectively adjusting the distance between the first end of the first shaft and the first end of the second shaft;

a first bracket pivotally connected to the first end of the first shaft, the first bracket comprising;

a first leg member connected to one of the frame members defining one of the corners of the frame structure; and a second bracket pivotally connected to the first end of the second shaft, the second bracket comprising:

a first leg member connected to the other one of the frame members defining the respective corner of the frame structure.

2. An adjustable frame as defined in claim 1, wherein the adjustment means permits the first end of the first shaft and the first end of the second shaft of each corner adjustment assembly to be moved in one direction away from each other and in an opposite direction toward each other.

3. An adjustable frame as defined in claim 1 wherein the corner adjustment assemblies are disposed across at least a portion of the open area adjacent a respective one of the corners of the frame structure.

4. An adjustable frame as defined in claim 1, wherein the frame structure includes a pair of opposing frame members, and wherein the adjustable frame further comprises:

a brace member disposed between the pair of opposed frame members so as to permit movement therebetween; and brace adjustment means engaging at least a portion of the brace member and at least one of the pair of opposed frame members for selectively adjusting the distance between the opposed frame members.

5. An adjustable frame as defined in claim 4, wherein the brace adjustment means includes a first substantially L-shaped bracket disposed on the brace member, the first L-shaped bracket having a first leg member, and a second leg member extending from the first leg member, the first leg member being connected to one side of the brace member such that the second leg member extends a distance from the brace member and the second leg member having a threaded aperture formed through a portion thereof; and wherein the brace adjustment means further includes a first threaded shaft disposed in the threaded aperture of the second leg member such that upon rotation of the first threaded shaft in a preselected direction, one end of the first threaded shaft moves a distance beyond one end of the brace member to engage at least one of the pair of opposed frame members.

6. An adjustable frame as defined in claim 5, wherein the brace adjustment means includes a second substantially L-shaped bracket disposed on the brace member, the second L-shaped bracket having a first leg member, and a second leg member extending from the first leg member, the first leg member of the second L-shaped bracket being connected to an opposite side of the brace member from which the first L-shaped bracket is disposed such that the second leg member of the second L-shaped bracket extends a distance from the brace member, the second leg member of the second L-shaped bracket having a threaded aperture formed through a portion thereof; and wherein the brace adjustment means further includes a second threaded shaft disposed in the threaded aperture of the second leg member of the second L-shaped bracket such that upon rotation of the second threaded shaft in a preselected direction the second threaded shaft moves a distance beyond the one end of the brace member.

7. An adjustable frame as defined in claim 1 wherein the first end of the first shaft and the first end of the second shaft of each corner adjustment assembly are disposed in a line which is substantially parallel with a diagonal line extending generally between adjacently disposed internal corners of the frame structure.

8. An adjustable frame as defined in claim 7 wherein the frame structure comprises:

a first end frame member;

a second end frame member;

a first side frame member; and a second side frame member, the first end frame member, the second end frame member, first side frame member and second side frame member cooperating to form a substantially rectangular frame structure having four internal corners;

wherein the frame structure has a length, a width, a first distance and a second distance, the length of the frame structure extending generally along one of the first and second end frame members from one internal corner of the frame structure to an opposite internal corner of the frame structure, the width of the frame structure extending generally along one of the first and second side frame members from one internal corner of the frame structure to an opposite internal corner of the frame structure, the first distance extending generally along one of the first and second end frame members from one internal corner to the location of the pivotal connection between the one of the first and second end frame members and one of the corner adjustment assemblies which is disposed adjacent the one respective internal corner, the second distance extending generally along one of the first and second side frame members which is disposed adjacent the one of the first and second end frame members from the one respective internal corner to the location of the pivotal connection between the one of the first and second side frame members and the one respective corner adjustment assembly, and wherein the ratio of the first distance of the frame structure divided by the second distance of the frame structure is about equal to the ratio of the length of the frame structure divided by the width of the frame structure.

9. An adjustable frame as defined in claim 1, wherein each of the corner adjustment assemblies further comprise:

a second leg member rigidly connected to the first leg member of the first bracket and rigidly connected to another surface of the respective one of the pair of adjacently disposed frame members defining the corner; and a second leg member rigidly connected to the first leg member of the second bracket and rigidly connected to another surface of the respective one of the pair of adjacently disposed frame members defining the corner to which the first body member of the second bracket is connected.

10. An adjustable frame as defined in claim 9, wherein the first leg member and the second leg member of the first bracket are angularly disposed at an angle of about 90 degrees; and wherein the first leg member and the second leg member of the second bracket are angularly disposed at an angle of about 90 degrees.

11. An adjustable frame as defined in claim 1, wherein the adjustment means includes:

coupling means for threadingly coupling each of the first shafts to a respective one of the second shafts whereby upon rotation of the coupling means in one direction the distance between the first end of the first shaft and the first end of the second shaft of the corner adjustment assemblies is increased, and upon rotation of the coupling means in an opposite direction the distance between the first end of the first shaft and the first end of the second shaft of the adjustment assemblies is decreased.

12. A method for producing an adjustable frame for stretching and supporting a painter's canvas, comprising the steps of:

(a) providing a polygonally shaped frame structure encompassing an open area and supporting the painter's canvas across the open area encompassed by the frame structure, the frame structure comprising:

a plurality of frame members cooperatively positioned to form the frame structure, each frame member having one end slidably connected to an adjacently disposed frame member to define one respective corner of the frame structure;

(b) providing a plurality of corner adjustment assemblies, each corner adjustment assembly including:

a first shaft having a first end;

a second shaft having a first end the first end of the first shaft being spaced a distance from the first end of the second shaft;

a first bracket pivotally connected to the first end of the first shaft, the first bracket comprising:

a first leg member connectable to one of the frame members defining one of the corners of the frame structure; and a second bracket pivotally connected to the first end of the second shaft, the second bracket comprising:

a first leg member connectable to the other one of the frame members defining the respective corner of the frame structure;

(c) connecting the first leg member of the first bracket of one of the corner adjustment assemblies to one of a pair of adjacently disposed frame members defining one corner of the frame structure and, the first leg member of the second bracket of the one respective corner adjustment assembly to the other one of the pair of adjacently disposed frame members defining the respective corner;

(d) repeating step (c) a predetermined number of times to connect one corner adjustment assembly to each corner of the frame structure;

(e) adjusting, selectively, the distance between the first end of the first shaft and the first end of the second shaft of at least one of the corner adjustment assemblies such that the pairs of adjacently disposed frame members defining the corners of the frame structure are selectively movable in response to the selective adjustment of the corner adjustment assemblies to thereby adjust the tension in the painter's canvas supported by the frame structure.

13. A method for producing an adjustable frame as defined in claim 12, wherein in step (b) the corner adjustment assemblies are provided in a collapsed position; and wherein in step (e), the first end of the first shaft and the first end of the second shaft of each corner adjustment assembly are moved in one direction away from each other to adjust the tension in the painter's canvas supported by the frame structure.

14. A method for producing an adjustable frame as defined in claim 12, wherein step (c) includes the step of disposing the corner adjustment assembly across at least a portion of the open area adjacent one of the corners of the frame structure.

15. A method for producing an adjustable frame as defined in claim 12, wherein step (c) includes the step of disposing the first end of the first shaft and the first end of the second shaft of each corner adjustment assembly in a line which is substantially parallel with a diagonal line extending generally between respective interior portions of opposing ends of the pair of adjacently disposed frame members to which the first end of the first shaft and the first end of the second shaft of the corner adjustment assembly will be connected.

16. A method for producing an adjustable frame as defined in claim 12, wherein in step (b), each of the corner adjustment assemblies are provided with a substantially same length extending generally between the first end of the first shaft and the first end of the second shaft thereof; and wherein step (c) is preceded by the steps of:

(ba) disposing a string diagonally across the open area encompassed by the frame structure from one corner of the frame structure to an opposing corner of the frame structure;

(bb) disposing the first end of one of the first and second shafts of one of the corner adjustment assemblies adjacent the one corner such that the first end of the other one of the first and second shafts of the one corner adjustment assembly is disposed a distance from the one corner along the string;

(bc) measuring from the one corner along one of the pair of adjacently disposed frame members defining the one corner to a point disposed substantially normal to the first end of the other one of the first and second shafts of the one corner adjustment assembly to obtain a first measurement;

(bd) measuring from the one corner along the other one of the pair of adjacently disposed frame members defining the one corner to a point disposed substantially normal to the first end of the other one of the first and second shafts of the corner adjustment assembly to obtain a second measurement;

and wherein step (c) is further defined as connecting the first leg member of the first bracket of one of the corner adjustment assemblies to the one of the pair of adjacently disposed frame members defining one corner of the frame structure at a location which is disposed a distance substantially equal to the first measurement from the one corner, and connecting the first leg member of the second bracket of the one corner adjustment assembly to the other one of the pair of adjacently disposed frame members defining the one corner of the frame structure at a location which is disposed a distance substantially equal to the second measurement from the one corner such that the first end of the first shaft and the first end of the second shaft of the one corner adjustment assembly are disposed substantially parallel with a diagonal line extending generally between adjacently disposed corners.

17. An adjustment assembly for an adjustable frame having at least two frame members which are adjacently disposed to form a corner, comprising:

a first shaft having a first end;

a second shaft having a first end, the first end of the first shaft being spaced a distance from the first end of the second shaft;

adjustment means for selectively adjusting the first end of the first shaft relative to the first end of the second shaft;

a first bracket connectable to one of the frame members and pivotally connected to the first end of the first shaft, the first bracket comprising:

a first leg member; and a second leg member rigidly connected to the first leg member and angularly disposed therefrom; and a second bracket connectable to the other one of the frame members and pivotally connected to the first end of the second shaft, the second bracket comprising:

a first leg member; and a second leg member rigidly connected to the first leg member of the second bracket and angularly disposed therefrom.

18. An adjustment assembly as defined in claim 17, wherein the first leg member and the second leg member of the first bracket are angularly disposed at an angle of about 90 degrees and wherein the first leg member and the second leg member of the second bracket are angularly disposed at an angle of about 90 degrees.

19. An adjustment assembly as defined in claim 18, wherein the first shaft is a threaded shaft and wherein the second shaft is a threaded shaft.

20. An adjustable frame for stretching and supporting a painter's canvas, comprising:

a polygonally shaped frame structure encompassing an open area and adapted to support the painter's canvas across the open area, the frame structure comprising:

a plurality of frame members cooperatively positioned to form the frame structure wherein a pair of the frame members are opposed relative to each other, each frame member having one end movably connected to an adjacently disposed frame member to define one respective corner of the frame structure;

a plurality of corner adjustment assemblies, each corner adjustment assembly having a first end pivotally connected to one of a pair of adjacently disposed frame members defining one of the corners of the frame structure and, a second end pivotally connected to the other one of the pair of adjacently disposed frame members defining the one respective corner;

adjustment means for selectively adjusting at least one of the first and second ends of each corner adjustment assembly such that the pairs of adjacently disposed frame members defining the corners of the frame structure are selectively movable in response to the selective adjustment of the corner adjustment assemblies to thereby adjust the tension in the painter's canvas supported by the frame structure;

a brace member disposed between the pair of opposed frame members so as to permit movement therebetween; and brace adjustment means engaging at least a portion of the brace member and at least one of the pair of opposed frame members for selectively adjusting the distance between the opposed frame members;

wherein the brace adjustment means includes a first substantially L-shaped bracket disposed on the brace member, the first L-shaped bracket having a first leg member, and a second leg member extending from the first leg member, the first leg member being connected to one side of the brace member such that the second leg member extends a distance from the brace member and the second leg member having a threaded aperture formed through a portion thereof; and wherein the brace adjustment means further includes a first threaded shaft disposed in the threaded aperture of the second leg member such that upon rotation of the first threaded shaft in a preselected direction, one end of the first threaded shaft moves a distance beyond one end of the brace member to engage at least one of the pair of opposed frame members.

21. An adjustable frame as defined in claim 20, wherein the brace adjustment means includes a second substantially L-shaped bracket disposed on the brace member, the second L-shaped bracket having a first leg member and a second leg member extending from the first leg member, the first leg member of the second L-shaped bracket being connected to an opposite side of the brace member from which the first L-shaped bracket is disposed such that the second leg member of the second L-shaped bracket extends a distance from the brace member, the second leg member of the second L-shaped bracket having a threaded aperture formed through a portion thereof; and wherein the brace adjustment means further includes a second threaded shaft disposed in the threaded aperture of the second leg member of the second L-shaped bracket such that upon rotation of the second threaded shaft in a preselected direction the second threaded shaft moves a distance beyond the one end of the brace member.

22. An adjustable frame for stretching and supporting a painter's canvas, comprising:

a polygonally shaped frame structure encompassing an open area and adapted to support the painter's canvas across the open area, the frame structure comprising:

a plurality of frame members cooperatively positioned to form the frame structure, each frame member having one end movably connected to an adjacently disposed frame member to define one respective corner of the frame structure;

a plurality of corner adjustment assemblies, each corner adjustment assembly having a first end pivotally connected to one of a pair of adjacently disposed frame members defining one of the corners of the frame structure and, a second end pivotally connected to the other one of the pair of adjacently disposed frame members defining the one respective corner, and wherein each corner adjustment assembly further comprises:

a first bracket pivotally connected to the first end of the respective corner adjustment assembly; and a second bracket pivotally connected to the second end of the respective corner adjustment assembly wherein the first bracket comprising:

a first leg member rigidly connected to one surface of one of the pair of adjacently disposed frame members defining the corner; and a second leg member rigidly connected to the first leg member and rigidly connected to another surface of the respective one of the pair of adjacently disposed frame members defining the corner; and wherein the second bracket comprising:

a first leg member rigidly connected to one surface of the other one of the pair of adjacently disposed frame members; and a second leg member rigidly connected to the first leg member of the second bracket and rigidly connected to another surface of the respective one of the pair of adjacently disposed frame members defining the corner to which the first body member of the second bracket is connected;

adjustment means for selectively adjusting at least one of the first and second ends of each corner adjustment assembly such that the pairs of adjacently disposed frame members defining the corners of the frame structure are selectively movable in response to the selective adjustment of the corner adjustment assemblies to thereby adjust the tension in the painter's canvas supported by the frame structure.

23. An adjustable frame as defined in claim 22, wherein the first leg member and the second leg member of the first bracket are angularly disposed at an angle of about 90 degrees; and wherein the first leg member and the second leg member of the second bracket are angularly disposed at an angle of about 90 degrees.

24. A method for producing an adjustable frame for stretching and supporting a painter's canvas, comprising the steps of:

(a) providing a polygonally shaped frame structure encompassing an open area and supporting the painter's canvas across the open area encompassed by the frame structure, the frame structure comprising:

a plurality of frame members cooperatively positioned to form the frame structure, each frame member having one end slidably connected to an adjacently disposed frame member to define one respective corner of the frame structure;

(b) providing a plurality of corner adjustment assemblies, each corner adjustment assembly having a first end and a second end, each of the corner adjustment assemblies having substantially the same length extending generally between the first and second ends thereof;

(c) disposing a string diagonally across the open area encompassed by the frame structure from one corner of the frame structure to an opposing corner of the frame structure;

(d) disposing the first end of one of the corner adjustment assemblies adjacent the one corner such that the second end of the corner adjustment assembly is disposed a distance from the one corner along the string;

(e) measuring from the one corner along one of the pair of adjacently disposed frame members defining the one corner to a point disposed substantially normal to the second end of the corner adjustment assembly to obtain a first measurement;

(f) measuring from the one corner along the other one of the pair of adjacently disposed frame members defining the one corner to a point disposed substantially normal to the second end of the corner adjustment assembly to obtain a second measurement;

(g) connecting, pivotally, the first end of one of the corner adjustment assemblies to the one of a pair of adjacently disposed frame members defining one corner of the frame structure at a location which is disposed a distance substantially equal to the first measurement from the one corner, and connecting, pivotally, the second end of the one corner adjustment assembly to the other one of the pair of adjacently disposed frame members defining the one corner of the frame structure at a location which is disposed a distance substantially equal to the second measurement from the one corner such that the first end and the second end of the one corner adjustment assembly are disposed substantially parallel with a diagonal line extending generally between adjacently disposed corners (h) repeating step (g) a predetermined number of times to connect one corner adjustment assembly to each corner of the frame structure;

(i) adjusting, selectively, at least one of the first and second ends of at least one of the corner adjustment assemblies such that the pairs of adjacently disposed frame members defining the corners of the frame structure are selectively movable in response to the selective adjustment of the corner adjustment assemblies to thereby adjust the tension in the painter's canvas supported by the frame structure.

25. An adjustment assembly in combination with an item of furniture including at least two members with each member movably positioned with respect to the other member, the adjustment assembly comprising:

a first shaft having a first end;

a second shaft having a first end, the first end of the first shaft being spaced a distance from the first end of the second shaft;

adjustment means for selectively adjusting the distance between the first end of the first shaft and the first end of the second shaft;

a first bracket pivotally connected to the first end of the first shaft, the first bracket comprising:

a first leg member connected to one of the members; and a second bracket pivotally connectable to the first end of the second shaft, the second bracket comprising:

a first leg member connectable to the other one of the members.

* * * * *